United States Patent [19]

Wilson

[11] 4,329,754

[45] May 18, 1982

[54] CYLINDER MAINTENANCE TOOL

[76] Inventor: Ray Wilson, 2027 Washington, Chickasha, Okla. 73018

[21] Appl. No.: 216,445

[22] Filed: Dec. 15, 1980

[51] Int. Cl.[3] ..... F02B 77/04

[52] U.S. Cl. ..... 15/104.01 R; 15/236 R

[58] Field of Search ..... 15/104.01 R, 236 R, 15/104 R; 7/100, 163, 170; 81/1 R, 3 R

[56] References Cited

U.S. PATENT DOCUMENTS

| | | | |
|---|---|---|---|
| 1,022,040 | 4/1912 | Michener | 15/104.01 R |
| 1,202,352 | 10/1916 | Baxter | 15/104.01 R |
| 1,474,267 | 11/1923 | Kuhn | 15/104.01 R |
| 3,267,506 | 8/1966 | Van Patten | 15/236 R |

*Primary Examiner*—Edward L. Roberts

*Attorney, Agent, or Firm*—Robert M. Hessin

[57] ABSTRACT

An apparatus for clearing and cleaning of engine cylinder exhaust ports wherein access is gained through the spark plug receiving bore. The apparatus consists of a unitary cleaning tool having a handle end and a bent tool end extending at approximately 90° from said handle end, the tool end of the implement having a terminus of selected diameter and posteriorly extending lip formed thereon. In addition, the device utilizes a template which is readily affixed to the engine cylinder head to provide manipulative direction in cleaning selected ones of the exhaust ports of the engine.

12 Claims, 7 Drawing Figures

CYLINDER MAINTENANCE TOOL

BACKGROUND OF THE INVENTION

1. Field of the Invention

The invention relates generally to a hand operated clearing tool for cleaning the exhaust ports of engine cylinders and, more particularly, but not by way of limitation, it relates to an improved cylinder port cleaning tool for use with certain commercial two-cycle engines.

2. Description of the Prior Art

While the prior art includes numerous forms of hand-operated cutting and scraping tools for operation in and around engine cylinders, there does not appear to be any prior disclosure which is directed to non-mar clearing of individual cylinder ports, particularly as located in two-cycle engine cylinders. A patent of general interest is U.S. Pat. No. 3,267,506 in the name of Van Patten. This patent teaches a tool for use in the repair and maintenance of such as engines; however, it embodies shape and specific edges to implement cutting and scraping as it is particularly utilized in maintenance of diesel engines. Other patents found to be of general disclosure interest in prior searching are:

Wotton—U.S. Pat. No. 2,321,786
Chuck—U.S. Pat. No. 1,332,606
Calvert—U.S. Pat. No. 1,053,007
Vail—U.S. Pat. No. 1,091,604.

No prior art is known which is directed to a hand-operated fulcral tool such as that described and claimed herein.

SUMMARY OF THE INVENTION

The present invention relates to an improvement in hand tools for safely cleaning cylinder exhaust ports, particularly as they are located in certain commercial two-cycle engines. The device includes an elongated handle portion and a bent end portion having particular lip formation on the terminus. The bent end portion may then be inserted through the spark plug receiving bore into contact with the exhaust port location. A scored template is affixed to the cylinder head exterior adjacent the spark plug receiving bore to provide proper manipulative direction of the tool to effect safe cleaning, and a thread protector is disposed on the elongated handle portion of the tool to protect the thread structure of the spark plug receiving bore.

Therefore, it is an object of the present invention to provide a hand tool for safe and efficient cleaning of engine cylinder exhaust ports without damaging the internal cylinder walls or the spark plug receiving bore.

It is also an object of the present invention to provide an exhaust port cleaning tool that is specifically adapted for use with certain two-cycle engines.

It is still further an object of the present invention to provide an exhaust port cleaning tool that enables rapid operation with minimum defect to polished cylinder surfaces.

Finally, it is an object of the present invention to provide a unitary tool for cylinder port cleaning that has no individual moving parts that pertain to the cleaning function.

Other objects and advantages of the invention will be evident from the following detailed description when read in conjunction with the accompanying drawings which illustrate the invention.

DETAILED DESCRIPTION OF THE INVENTION

Figure 1:
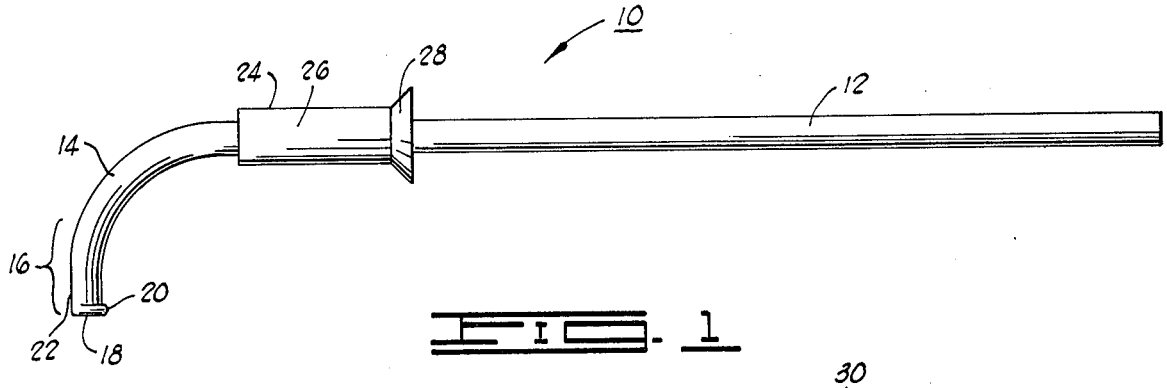
FIG. 1 is a view in side elevation of the cleaning tool of the present invention.

Referring to FIG. 1, a cleaning tool 10 is unitarily formed as an elongated handle end 12 and a tool end 14. The tool end 14 is bent to extend at approximately 90° from tool end 12 while defining a linear portion 16 on the order of $\frac{3}{4}$ inches length to enable cleaning insertion within port entries. A tool end terminus 18 defines a posteriorly flaring lip 20 of smooth configuration for contacting the cylinder port and surrounding surfaces.

Figure 2:
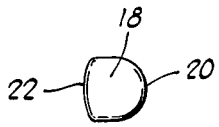
FIG. 2 is an end view of the terminus portion of the tool.

As shown also in FIG. 2, the terminus 18 is generally round as an anterior surface 22 of tool end 14 is ground to a greater radius of curvature, and the lip 20 takes the form of being generally round but posteriorly offset relative to the cross-section of linear portion 16 of tool end 14. A thread protector 24 is disposed securely on the inner end of handle end 12. Thread protector 24 is composed of resilient material, e.g. plastic, rubber or the like, and consists of a barrel part 26 and an integral collar part 28. When in use, the barrel portion 26 cushions tool movement against the threaded circumfery of the spark plug receiving bore, as will be further described below.

Figure 3:
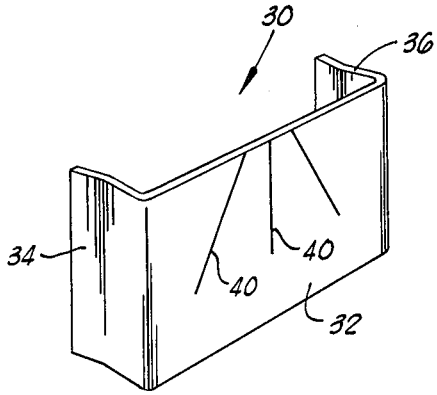
FIG. 3 is a perspective view of a first form of template utilized in the present invention.

FIG. 3 illustrates a first form of template 30 which is used in conjunction with cleaner tool 10 to aid in the manipulative cleaning operation. The template 30 may be bend-formed from light gauge metal to include a face plate 32 and opposite side clamps 34 and 36. Template 30 may also include a bottom folded panel 38 (FIG. 5) which serves as a positioning aid when the template 30 is in operative placement on the cylinder head, as will be further described. The face plate 32 of template 30 includes a plurality of score marks 40 of selected angular orientation relative to the spark plug receiving bore to indicate direction of the internal exhaust ports during use of cleaning tool 30, as will also be further described.

Figure 4:
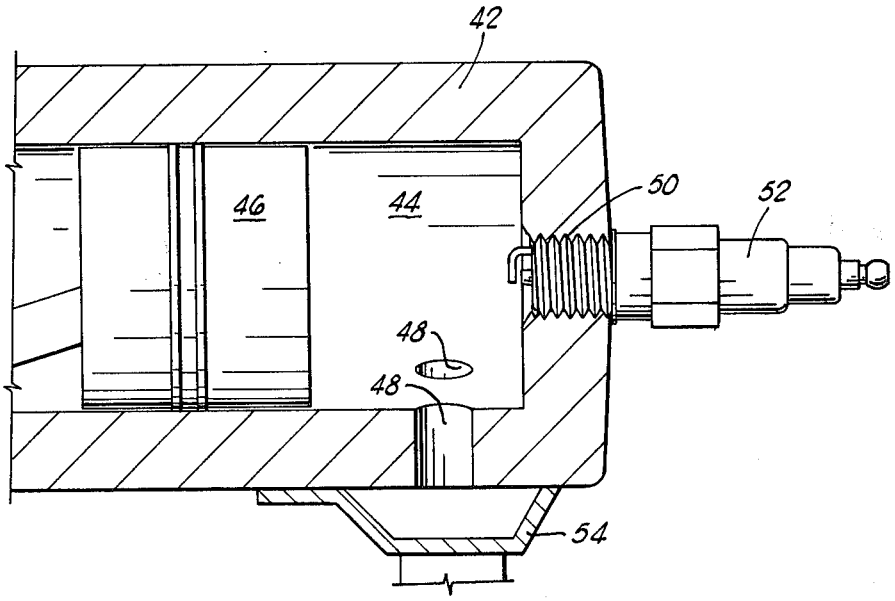
FIG. 4 is a vertical cross-section of a typical two-cycle engine cylinder including piston, spark plug and exhaust ports.

FIG. 4 illustrates a conventional type of small two-cycle utility engine cylinder structure. In this case, the representation is the Model C or Model D type of LAWNBOY lawnmower engine cylinder. Typically, the engine cylinder consists of a cylinder head 42 defining a cylinder wall 44 for reciprocation of a piston 46. Three exhaust ports 48 (one and one-half being shown) are disposed through cylinder wall 44 around the lower side, and an axial spark plug receiving bore 50 receives spark plug 52. The exhaust ports 48 each communicate with an exhaust manifold structure 54 for diffusion and elimination of combustion gases.

Figure 5:
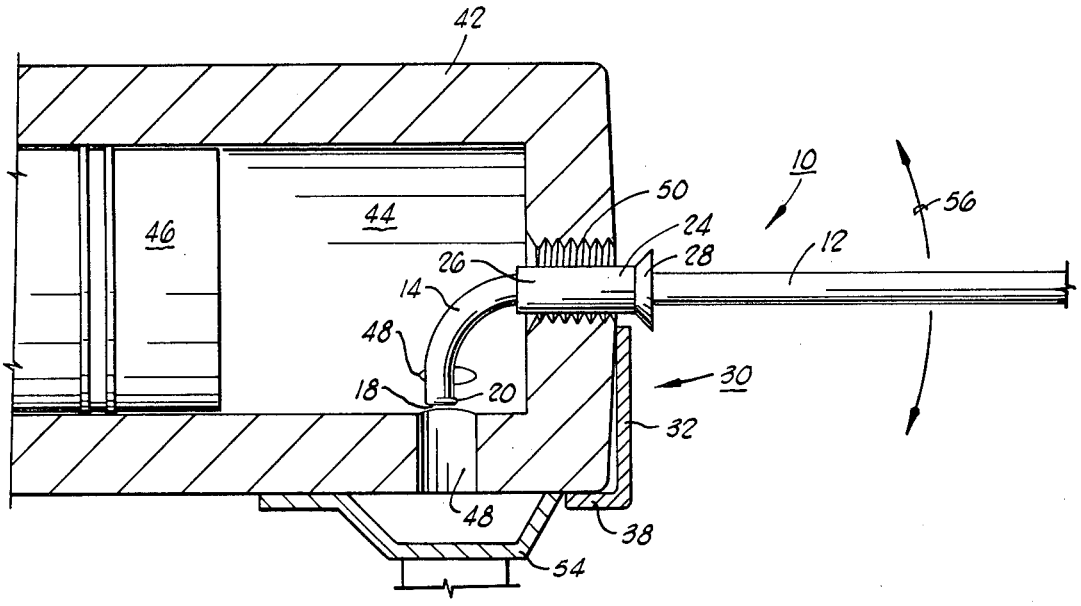
FIG. 5 is a vertical cross-section of an engine cylinder with spark plug removed and cleaning tool inserted in operative alignment.

FIG. 5 illustrates the cleaner tool 10 in operative disposition within a cylinder head 42 such as that shown in FIG. 4. Thus, the tool end 14 of cleaner tool 10 is inserted through spark plug receiving bore 50 and positioned with the resilient thread protector 24 adjacent to receiving bore 50. The template 30 (for Model C and D LAWNBOY engines) is then placed in clamping engagement on cylinder head 42 on the lower side of receiving bore 50 with the mid score line 40 (FIG. 3) vertically aligned therewith. Manipulation of the cleaner tool 10, as indicated by arrows 56, along each of the radial directions indicated by score lines 40 of template 30 will enable the terminus 18 and lip 20 to be directed to the respective angularly arrayed exhaust ports 48 for the clearing and cleaning operation. The plurality of score lines 40 on template 30 may be adapted for whatever the particular engine undergoing cleaning, and it should be understood that the diameter of terminus 18 and lip 20 may be varied in accordance with the exigencies of the particular engine and exhaust port specifications. During the cleaning operation, with rocking movement of tool handle end 12 along the motion of arrow 56, the barrel portion 26 of thread protector 24 prevents damage to the threads of receiving bore 50 as the resilient collar portion 28 aids in depth of insertion and alignment of tool 30. With such cleaning, all gum and deposit is forced down into exhaust manifold 54 and harmlessly evacuated.

Figure 6:
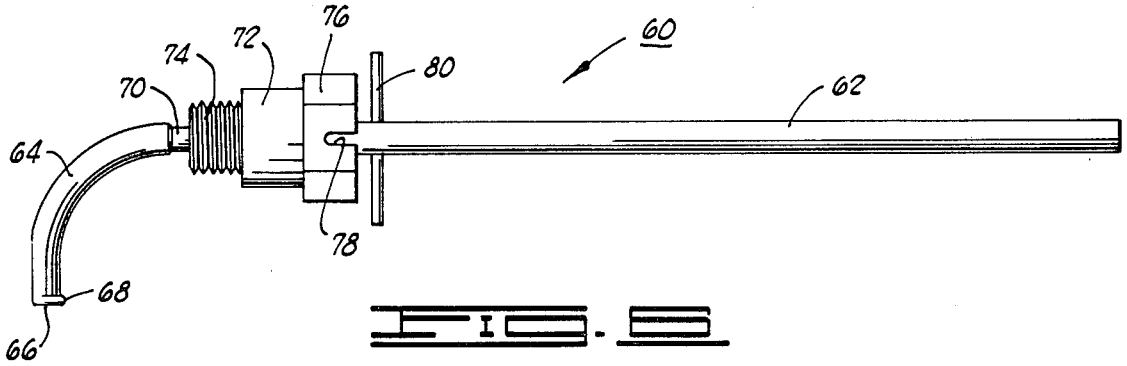
FIG. 6 is an alternative form of port cleaning tool.

FIG. 6 shows an alternative form of cleaner tool 60 that includes a handle end 62 and tool end 64 with similar terminus 66 and posteriorly extending lip 68. In this embodiment, handle end 62 includes a reduced diameter portion 70 and a captively retained nipple 72 having a thread portion 74 that serves the thread protection function as it is screwed within spark plug receiving bore 50. The nipple 72 includes a hex head formation 76 which may be used for aid in screw insertion, or the portion 76 may include diametrically opposed slots 78 for mesh with a tightening rod 80 disposed through handle end 62. Either mode may be used for insertion and release of nipple 72 from the spark plug receiving bore 50. While nipple 72 is captively retained on handle 62, there is clearance such that cleaner tool 60 can be readily manipulated through nipple 72 to carry out the cleaning and clearing action through manipulative rocking of handle end 62.

Figure 7:
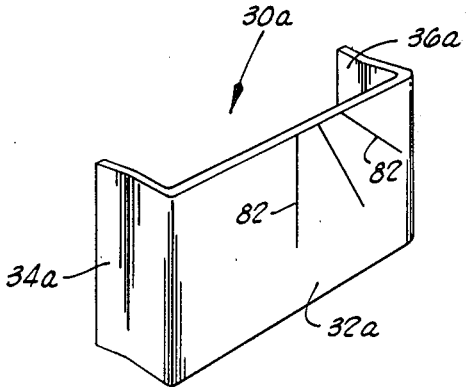
FIG. 7 is an alternative form of template used with selected two-cycle engines.

FIG. 7 illustrates yet another form of template which may be used in the exhaust port cleaning operation. In this case, the template **30*a* consists of a face plate 32*a* and opposite clamping side plates 34*a* and 36*a*; however, the three exhaust port score indicators 82 are aligned in an offset manner. The template 30*a* of FIG. 7 is aligned with score indicators 82** adapted for use with the Model F LAWNBOY small utility engine.

It should be understood that the tool of the present invention as well as the template indicators used in combination therewith can be varied in accordance with particular engine requirements and design specifications. Thus, the diameter of tool end terminus 18 may be varied in accordance with particular port diameter requirements, and the positioning of the thread protector along the tool handle may be predetermined by matching with port disposition and internal cylinder measurements. The tool of the present invention serves to enable cleaning maintenance of small utility engines as the exhaust ports and internal cylinder surfaces are readily cleared without danger of damaging or nicking internal cylinder walls, spark plug receiving threads, and the like.

Changes may be made in combination and arrangement of elements as heretofore set forth in the specification and shown in the drawings; it being understood that changes may be made in the embodiments disclosed without departing from the spirit and scope of the invention as defined in the following claims.

What is claimed is:

1. Apparatus for clearing engine cylinder exhaust ports by access through the spark plug receiver bore, comprising:

a rod implement having an elongated handle portion and a bent tool end portion extending at approximately ninety degrees therefrom; and template means affixable to the engine cylinder adjacent said plug receiving bore to indicate direction of exhaust ports when said rod implement bent tool end is inserted in said plug receiving bore for clearing operation.

2. Apparatus as set forth in claim 1 which further includes:

thread protector means disposed on said rod implement elongated handle portion adjacent said bent tool end portion for operative disposition within said plug receiving bore.

3. Apparatus as set forth in claim 2 wherein said thread protector means comprises:

resilient sleeve means securely retained on said elongated handle end portion.

4. Apparatus as set forth in claim 2 wherein said thread protector means comprises:

threaded sleeve means captively retained on said elongated handle end portion.

5. Apparatus as set forth in claim 1 wherein said rod implement is further characterized in that:

said bent tool end portion includes a terminus formed with a generally circular lip portion offset toward the radius of bend.

6. Apparatus as set forth in claim 5 wherein said thread protector means comprises:

resilient sleeve means securely retained on said elongated handle end portion.

7. Apparatus as set forth in claim 5 wherein said thread protector means comprises:

threaded sleeve means captively retained on said elongated handle end portion.

8. Apparatus as set forth in claim 1 wherein said template means includes:

scored indications aligning the engine cylinder exhaust ports with said spark plug receiving bore.

9. Apparatus for clearing engine cylinder exhaust ports by access through the spark plug receiving bore, comprising:

a rod implement having an elongated handle portion and a bent tool end portion extending at approximately ninety degrees therefrom, said bent tool end portion including a terminus formed with a generally circular lip offset inwardly toward the radius of the bend.

10. Apparatus as set forth in claim 9 which further includes:

thread protector means disposed on said rod implement elongated handle portion adjacent said bent tool end portion for operative disposition within said plug receiving bore.

11. Apparatus as set forth in claim 10 wherein said thread protector means comprises:

resilient sleeve means securely retained on said elongated handle end portion.

12. Apparatus as set forth in claim 10 wherein said thread protector means comprises:

threaded sleeve means captively retained on said elongated handle end portion.

* * * * *